United States Patent [19]

Henley

[11] Patent Number: 4,583,530

[45] Date of Patent: Apr. 22, 1986

[54] FLUIDIZED BED APPARATUS FOR TREATING EQUINE BODY PARTS

[76] Inventor: Ernest J. Henley, 358 Westminister, Houston, Tex. 77024

[21] Appl. No.: 605,823

[22] Filed: May 1, 1984

[51] Int. Cl.[4] ..... A61H 9/00

[52] U.S. Cl. ..... 128/65; 128/24.1; 128/38

[58] Field of Search ..... 128/367, 368, 369, 370, 128/65, 66, 24.1, 24.2, 38; 220/8; 119/158; 4/585, 599

[56] References Cited

U.S. PATENT DOCUMENTS

| | | | |
|---|---|---|---|
| 2,880,902 | 4/1959 | Owsen | 220/8 |
| 2,956,565 | 10/1960 | Anderson | 128/65 |
| 2,975,786 | 3/1961 | Williams | 128/65 |
| 3,155,072 | 11/1964 | Owens | 128/66 |
| 3,191,190 | 6/1965 | Lowry | 4/585 |
| 3,378,004 | 4/1968 | Claycomb et al. | 128/370 |
| 3,760,800 | 8/1973 | Staffin et al. | 128/38 |
| 3,837,334 | 9/1974 | Johnson | 128/66 |
| 4,142,537 | 3/1979 | Fenelon | 220/8 |
| 4,214,576 | 7/1980 | Henley | 128/38 |
| 4,498,462 | 2/1985 | Henley | 128/65 |

FOREIGN PATENT DOCUMENTS

| | | | |
|---|---|---|---|
| 757759 | 1/1934 | France | 128/66 |

*Primary Examiner*—Gene Mancene
*Assistant Examiner*—Cary E. Stone
*Attorney, Agent, or Firm*—Charles Walter

[57] ABSTRACT

Method and apparatus for equine therapy by immersion in a fluidized solids bed.

5 Claims, 7 Drawing Figures

FLUIDIZED BED APPARATUS FOR TREATING EQUINE BODY PARTS

CROSS REFERENCE TO RELATED PATENTS AND APPLICATIONS

This application relates to improvements in the apparatus and method disclosed in U.S. Pat. No. 3,860,800 issued Sept. 25, 1973, U.S. Pat. No. 4,214,576 issued July 29, 1980, and United States patent application Ser. No. 318,376 filed Nov. 5, 1981. The improvements are necessary for using the apparatus and method for equine therapy.

BACKGROUND OF THE INVENTION

Fluidotherapy® is based on the recent discovery that, under certain hydrodynamic conditions, sold particles can be suspended in air in such a manner that the air mixture possesses the properties of a fluid. In effect, the mixture is a dry whirlpool which provides a strong massaging action and transfers heat or cold to body tissue in an especially efficient manner.

The reference patents and application disclose forms of Fluidotherapy® Units for providing massage and heat or cold to the arms, legs and other body parts of a human subject. While these Units are extremely efficient for treating human body parts, there are several reasons why they cannot be used for treating horses. The underlying reason, of course, is that horses are intellectually, physiologically, and anatomically different than humans.

At present, apparatus and methods for applying massage and heat to equine body parts are primarily conventional water whirlpool baths. Since Fluidotherapy® treatment comprises a substantial improvement over water whirlpool baths for the treatment of body parts, it would be highly desirable to have a Fluidotherapy® apparatus and method capable of being used for treating horses.

As described above, horses cannot be treated with the Fluidotherapy® Units described in the reference patents and application for a number of reasons. Among these are the following:

Fluidotherapy® Units for treating horses should be large enough to accommodate two equine legs. Further, it would be desirable to place equine legs in a therapy bed that can be enlarged in depth after both legs have been placed in the bed. Therefore, means for increasing the capacity of the fluid bed container after both legs have been placed in the therapy unit is desirable for Fluidotherapy® Units for treating horses.

Fluidotherapy® Units for treating horses should be open at the top so that the equine legs can be placed into the bed and removed from the bed easily.

However, when air flow through an uncovered bed commences, particle spouting becomes a problem. Therefore, the use of denser and/or larger bed particles is desirable for Fluidotherapy® Units for treating horses.

Fluidotherapy® Units for treating horses should be constructed to support the mass applied by the horse during therapy. Therefore, means for supporting mass applied by the horse as well as the mass of the particulate bed is desirable in Fluidotherapy® Units for treating horses.

Fluidotherapy® Units for treating horses should be durable enough to withstand hoof movement and impact during therapy. However, the walls of the bed container should not be a hard material such as steel, so that the equine leg is not damaged if it kicks against said walls. Therefore, the walls of the bed container should be constructed of a suitable material, and the air flow distributor must be covered by a means that will not impede air flow but will protect the distributor from the equine mass and the impact of hooves during therapy.

Fluidotherapy® treatment of horses would be beneficial for treatment of pain. For example, treatment is indicated for pain following injuries to tissue or from contusions, extension, distortion or luxation of the joints, or for pain due to degenerative rheumatic tissue alterations, and overstrain.

Fluidotherapy® treatment of horses would be beneficial for treatment of range of motion including treatment for dermatogenous, tendogenous, myogenous, neurogenous and arthrogenous contractures, and restricted range of motion due to fractures, performance injuries and arthritis.

Fluidotherapy® treatment of horses would be beneficial for treatment of blood flow insufficiency, insofar as vascular insufficiency can be influenced by heat.

Fluidotherapy® treatment of horses would be beneficial for treatment of wounds and swelling including post-operative muscle, tendon and nerve repair, open wounds resulting from surgical procedures or accidents, and closed, traumatic or post-surgical wounds and swellings following injury to extremities.

SUMMARY OF THE INVENTION

The present invention is directed to a Fluidotherapy® Unit so constructed and arranged as to lend itself to use on horses.

Further, the present invention is directed to an open Fluidotherapy® Unit.

Further, the present invention is directed to a Fluidotherapy® Unit that is constructed to accommodate the mass applied by a horse.

Further, the present invention is directed to a Fluidotherapy® Unit that is constructed to withstand hoof impact during therapy without injuring the horse.

Further, the present invention is directed to a Fluidotherapy® Unit for the treatment of equine pain.

Further, the present invention is directed to a Fluidotherapy® Unit for the treatment of restricted equine range of motion.

Further, the present invention is directed to a Fluidotherapy® Unit for the treatment of equine blood flow insufficiency.

Further, the present invention is directed to a Fluidotherapy® Unit for the treatment of equine arthritis, wounds and swelling.

DESCRIPTION OF CERTAIN PREFERRED EMBODIMENTS

Figure 1:
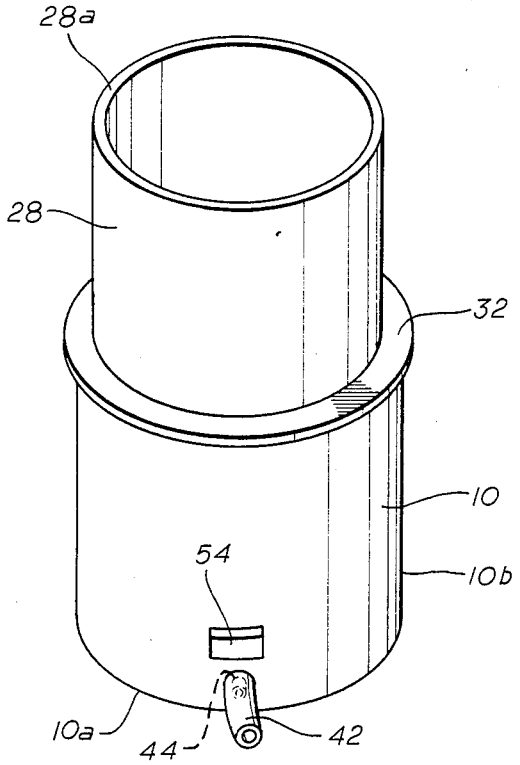
FIG. 1 is a perspective view of a basic unit capable of receiving two equine legs with recycle heating.
Figure 2:
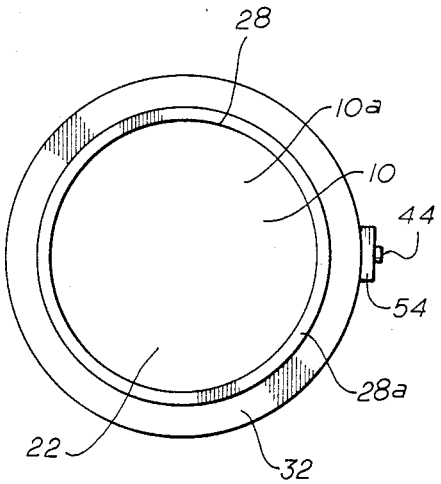
FIG. 2 is a top view of the treatment chamber of the unit illustrated in FIG. 1.
Figure 3:
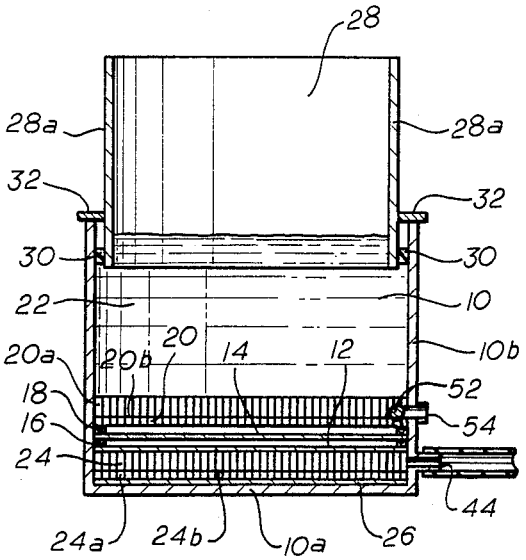
FIG. 3 is a vertical cross section of the treatment chamber of the unit illustrated in FIG. 1.

A preferred embodiment of the present invention appears in FIGS. 1, 2, and 3.

Structurally, container 10, which may be constructed of 3/16 inch polypropylene or any other soft, flexible material of sufficient strength to withstand frequent contact with hooves, comprises a bottom wall 10*a* and side walls 10*b*. Horizontal perforated plate 12 is supported by a support means which rests on bottom wall 10*a* of container 10. Distributor 14 is sandwiched between a first horizontal flange 16, which rests on plate 12, and a second horizontal flange 18, which is hermetically sealed to walls 10*b* of container 10 by means such as hot glue. Horizontal grating 20 rests on flange 18 above distributor 14. Plate 12 may be steel, distributor 14 may be ⅜ inch 4 pound charcoal ester or any other material suitable for distributing the flow of a gas, flanges 16 and 18 may be wooden, and grating 20 may be constructed of a pluarity of aluminum I-bars 20*a* held in place by a pluarity of rods 20*b*.

The support means for plate 12, distributor 14, flanges 16 and 18, and grating 20 is sufficient to support the mass of particulate material 22, and the mass supported by the body part or parts immersed therein. Particulate material 22, which may be granules of Soltex 9605, must be of sufficiently small density and size to permit fluidization at low air flow. In the preferred embodiment of the present invention illustrated in FIGS. 1, 2 and 3, the support system comprises a pluarity of aluminum I-bars 24*a* held in place by a pluarity of rods 24*b* resting on bottom liner 26, which may be constructed of plywood. Liner 26 rests directly on bottom wall 10*a* of container 10. If liner 26 is omitted, grating 24 rests directly on bottom wall 10*a* of container 10.

Container extension 28 may be constructed of the same flexible material as container 10. The dimensions of the outer perimeter of walls 28*a* of extension 28 are slightly less than the dimensions of the inner perimeter of walls 10*b* of container 10 thereby permitting extension 28 to fit loosely into the upper part of container 10. Seal 30, which may be constructed of ordinary foam weather stripping is attached to the outer perimeter of the bottom of wall 28*a* of extension 28 by means well known to those skilled in the art and spans any space between the outer perimeter of the bottom of wall 28*a* and the outer horizontal perimeter along wall 10*b*. Barrel lock ring 32 may be tightened around the outer perimeter of wall 10*b* in a horizontal plane with seal 30, thereby holding the top of extension 28 at positions above the top of container 10, or ring 32 may be removed, thereby permitting the bottom of extension 28 to slide down into container 10.

Figure 4:
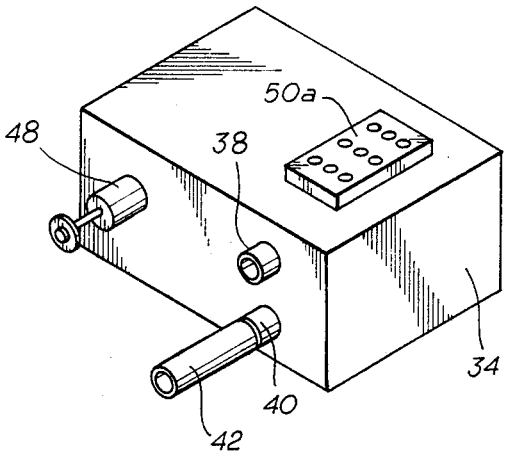
FIG. 4 is a more-or-less diagrammatic showing of a blower unit with heater.
Figure 5:
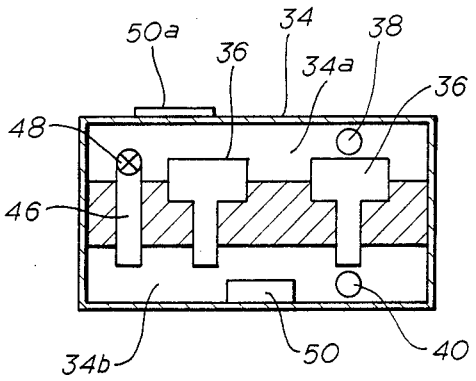
FIG. 5 is a vertical cross section of the blower unit with heater.

FIGS. 4 and 5 illustrate a preferred embodiment of the blower unit with heater for the present invention.

Structurally, motor and heater cabinet 34 is divided into a first chamber 34*a*, a second chamber 34*b*. Air movement means 36, which may be two Ametek #115717 vacuum motors, or other means capable of providing air flow velocity that is sufficient to cause fluidization of particulate material 22 is mounted between chambers 34*a* and 34*b*. Inlet 38 goes through a wall of chamber 34*a* of container 34, and outlet 40, which is in fluid communication with container 10 via hose 42 and inlet 44 of container 10, goes through a wall of chamber 34*b* of cabinet 34. Structurally, chambers 34*a* and 34*b* are in fluid communication via recycle pipe 46 and recycle control valve 48. In the preferred embodiment of the present invention illustrated in FIGS. 4 and 5, finned air heater 50 is located in chamber 34*b*. Control panel 50*a* contains the means whereby air movement means 36 and heater 50 is regulated.

A thermometer 52 has its bulb 54 immersed in the bed of particulate material 22 in cabinet 10 between I-bars 20*a* of grating 20.

Figure 6:
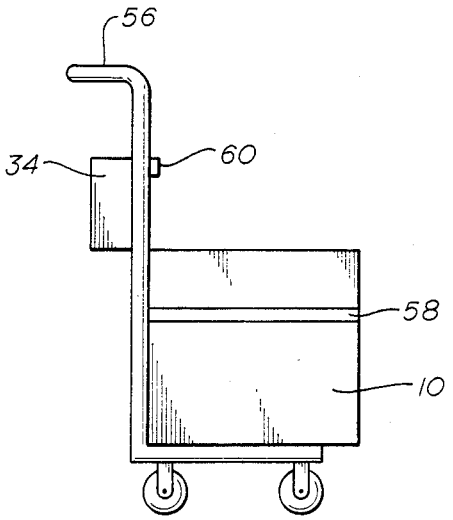
FIG. 6 is a more-or-less diagrammatic illustration of a unit mounted on a dolly.

FIG. 6 illustrates another preferred embodiment of the present invention in which the apparatus is secured on dolly 56 with strap 58 and hooks 60.

Functionally, two equine legs may be placed into bed material 22 in container 10 when extension 28 is in the lowered position with the hooves resting on grating 20 and the equine mass supported by grating 20 and its underlying support structure. After the animal accepts this situation extension 28 may be raised to the desired height and locked in place by tightening ring 32, and, if desired, additional particulate material may be added.

Functionally, air movement means 36 draws ambient air into chamber 34*a* of cabinet 34 via inlet 38 and moves said air into container 10 via chamber 34*b*, outlet 40, hose 42 and inlet 44. If valve 48 is open, a portion of the air in chamber 34*b* will recycle into chamber 34*a* via pipe 46, thereby increasing the temperature of the air in chamber 34*a*. When this warmer air is moved into container 10, the temperature of the therapy bed is increased accordingly. When the ambient air temperature is very low, heating means 50 illustrated in FIGS. 4 and 5 may be used to increase the temperature of the air moved into container 10.

Air movement means 36 forces air entering the lower portion of container 10 via inlet 44 to move up through grating 24, plate 12, distributor 14, grating 20 and particulate material 22. Functionally, when the velocity of the air flow through bed material 22 is sufficient, fluidization occurs.

Functionally, thermometer 52 may be used to monitor the bed temperature of material 22 during therapy. Temperature control is achieved by adjusting the recycle flow and heater controls.

Functionally, container 10 and cabinet 34 may be secured for transport or use with strap 58 and hooks 60, respectively.

A result of fluidization and heat on the immersed equine body parts is mechanical and thermal stimulation of the skin thereby producing counter-irritation which modulates sensory input thus blocking pain perception and response.

A result of the higher temperature achieved in Fluidotherapy® is lower viscosity or improved elasticity which alters rheological properites of the treated animal, thereby improving the range of motion in a physio-mechanical manner.

Another result of the higher temperature achieved in Fluidotherapy® is increased blood vessel dilation which increases equine blood flow dramatically.

Yet another result of the higher temperature achieved in Fluidotherapy® is accelerated biochemical reactions required for cell division and regeneration of new tissue which increases the healing rate of equine wounds and swelling.

EXAMPLE 1

The front legs of a six-year old chestnut stallion were immersed into a preferred embodiment of the present invention. In the embodiment used, the circumference of the treament chamber was 20 inches, and the height was variable from 12 to 24 inches. The initial bed temperature was 125° F. Carpus and fetlock temperature rises during therapy were monitored by positioning Type T copper-constantine thermocouples at a depth of 1.5 inches. Subcutaneous measurements were made with thermistors imbedded in 18-gauge hypodermic needles at a depth of 0.2 inches. For purposes of comparison, subcutaneous measurements were also taken during hydrotherapy treatment in a 22 inch wide, 16.5 inch deep bath with an aeration device (Wet-day Jet Vac 40, Shelton Products, Series 400) and initial bath temperature of 108° F.

Figure 7:
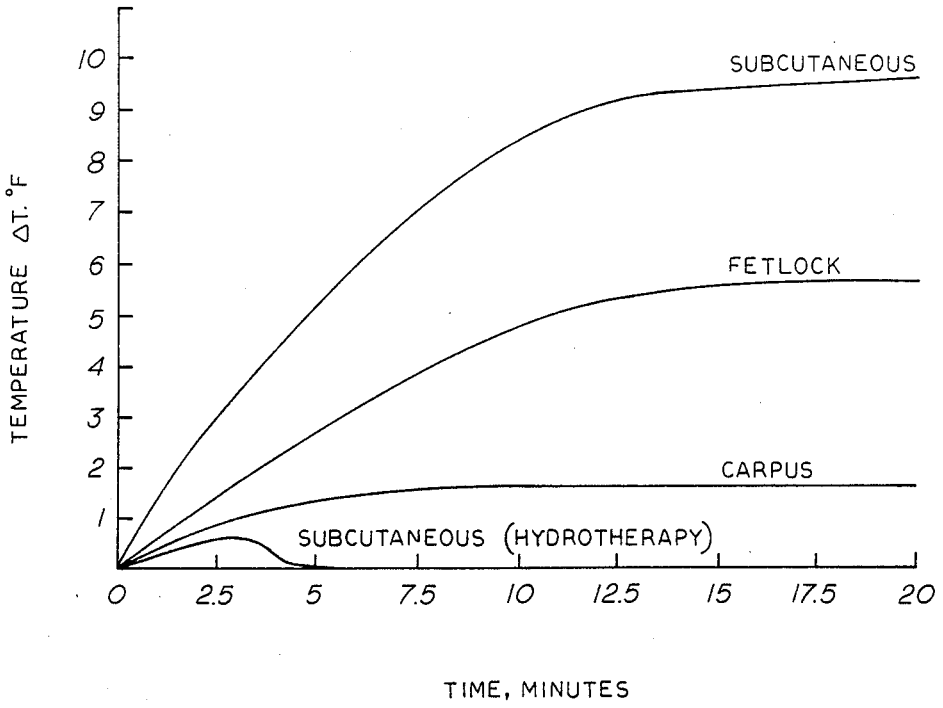
FIG. 7 illustrates subcutaneous, fetlock, and carpus temperature increases as a function of time for the present invention and compares the subcutaneous increase with that obtained with hydrotherapy.

FIG. 7 illustrates the temperature elevations as a function of time. The subcutaneous temperature rise in the embodiment of the present invention is substantially greater than the subcutaneous temperature rise in the hydrotherapy bath (HI-Drotherapy in FIG. 7). The fall in subcutaneous temperture, following the initial rise during hydrotherapy is attributed to continually decreasing water temperature.

EXAMPLES 2-6

Clinical observations using a preferred embodiment of the present invention on active racehorses under five years of age were made under field conditions. The treatment protocol comprised using therapy temperatures between 120°-140° F. for 30 to 45 minutes. 32% of the treatments were administered before workouts or races. 51% during the day, and 15% after races or workouts.

EXAMPLE 2

24 horses with primary a diagnosis of arthritic ankle received Fluidotherapy® treatments an average of 5.4 times per horse. All 24 horses regained full functionality.

EXAMPLE 3

52 horses with primary a diagnosis of arthritic knee received Fluidotherapy® treatments an average of 6.4 times per horse. All 52 horses regained full functionality.

EXAMPLE 4

16 horses with primary a diagnosis of bruised feet received Fluidotherapy® treatments an average of 4.2 times per horse. All 16 horses regained full functionality.

EXAMPLE 5

7 horses with primary a diagnosis of cuts and lacerations received Fluidotherapy® treatments an average of 6.2 times per horse. All 7 horses regained full functionality.

EXAMPLE 6

3 horses with primary a diagnosis of tendonitits received Fluidotherapy® treatments an average of 8.6 times per horse. All 3 horses regained full functionality.

I claim:

1. An apparatus for applying massage and heat to parts of an equine body comprising:

a flexible container having a bottom and side walls of sufficient dimensions to contain two equine legs;

means for varying the depth of said container;

a horizontal perforated plate spanning the perimeter of said container with support means comprising a grating extending from the underside of said plate to said bottom wall of said container;

a bed of particulate material capable of fluidization in gas enclosed by said side walls of said container and supported by said plate;

means for distributing gas flow into said bed;

means for heating a gas;

means of moving a gas through said distribution means and said bed; and means for protecting said distribution means from equine hooves.

2. An apparatus for applying massage and heat to parts of an equine body comprising:

a flexible container having a bottom and side walls of sufficient dimensions to contain two equine legs;

means for varying the depth of said container;

a horizontal perforated plate spanning the perimeter of said container with support means extending from the underside of said plate to said bottom wall of said container;

a bed of particulate material capable of fluidization in gas enclosed by said side walls of said container and supported by said plate;

distributing means for distributing gas flow into said bed comprising:

a first horizontal flange;

a second horizontal flange; and a horizontal sheet of charcoal ester between said first and second flanges;

means for heating a gas;

means of moving a gas through said distribution means and said bed; and means for protecting said distribution means from equine hooves.

3. An apparatus as in claim 2 wherein said distribution means is hermetically sealed to said side walls of said container.

4. An apparatus as in claim 3 wherein said distribution means divides said container into a lower chamber and an upper chamber.

5. An apparatus as in claim 4 wherein said upper chamber comprises at least ninety percent of the total volume of said container.

* * * * *